US008127470B2

(12) United States Patent
Connor

(10) Patent No.: US 8,127,470 B2
(45) Date of Patent: Mar. 6, 2012

(54) FOOTWEAR WITH PROJECTIONS ACTIVATED BY HORIZONTAL SLIDING

(76) Inventor: Robert A. Connor, Minneapolis, MN (US)

( * ) Notice: Subject to any disclaimer, the term of this patent is extended or adjusted under 35 U.S.C. 154(b) by 599 days.

(21) Appl. No.: 12/336,008

(22) Filed: Dec. 16, 2008

(65) Prior Publication Data

US 2009/0151199 A1 Jun. 18, 2009

Related U.S. Application Data

(60) Provisional application No. 61/007,879, filed on Dec. 17, 2007.

(51) Int. Cl.
*A43C 15/00* (2006.01)

(52) U.S. Cl. ..... 36/61; 36/67 R; 36/134

(58) Field of Classification Search ..... 36/100, 36/59 R, 61, 67 R, 134
See application file for complete search history.

(56) References Cited

U.S. PATENT DOCUMENTS

| | | | | | |
|---|---|---|---|---|---|
| 817,958 | A * | 4/1906 | Clugsten | 36/61 |
| 1,206,653 | A * | 11/1916 | Beard | 36/61 |
| 2,920,404 | A * | 1/1960 | Ross | 36/61 |
| 3,281,971 | A * | 11/1966 | Weitzner | 36/100 |
| 3,717,238 | A * | 2/1973 | Fox | 36/61 |
| 4,375,729 | A * | 3/1983 | Buchanen, III | 36/61 |
| 4,821,434 | A * | 4/1989 | Chein | 36/134 |
| 4,825,562 | A * | 5/1989 | Chuang | 36/61 |
| 5,337,494 | A * | 8/1994 | Ricker | 36/61 |
| 5,836,092 | A * | 11/1998 | Yarnell | 36/61 |
| 5,956,870 | A * | 9/1999 | Grossman et al. | 36/127 |
| 6,058,627 | A * | 5/2000 | Violette et al. | 36/61 |

* cited by examiner

*Primary Examiner* — Marie Patterson
(74) *Attorney, Agent, or Firm* — Schwegman, Lundberg & Woessner, P.A.

(57) ABSTRACT

Surface-engaging footwear projections can automatically be activated by horizontal sliding motion. In an example, horizontal sliding motion can turn one or more circular rolling members, such as around a horizontal axis, or move one or more sliding members along a horizontal track. The motion of such rolling or sliding members can cause one or more surface-engaging projections to move downward from the footwear into contact with the surface, which can then help slow or stop the horizontal sliding motion.

16 Claims, 4 Drawing Sheets

FOOTWEAR WITH PROJECTIONS ACTIVATED BY HORIZONTAL SLIDING

CLAIM OF PRIORITY

This patent application claims the benefit of priority, under 35 U.S.C. Section 119(e), to Robert A. Connor U.S. Provisional Patent Application Ser. No. 61/007,879, entitled "SHOE SPIKES OR CLEATS ACTIVATED BY SLIDING OR SHEARING MOTION," filed on Dec. 17, 2007, the content of which is incorporated herein by reference in its entirety.

BACKGROUND

One function of footwear is to provide traction. Traction can help the wearer to change from a stationary state to a moving state (such as starting a race), to change from a moving state to a stationary state (such as stopping a slide on ice), or to change direction when moving (such as pivoting in a basketball game). Some circumstances need more traction, and specialized footwear has been created for those circumstances. For example, high-traction footwear with spikes, cleats, or other surface-engaging projections have been created, such as for playing certain sports and for walking on slippery surfaces.

Many types of footwear provide permanent surface-engaging projections. However, there are limitations to such footwear with permanent surface-engaging projections. For example, the wearer may walk on different types of surfaces. Permanent projections may be appropriate for some of these surfaces, but not others. These latter surfaces may damage the projections, or may be damaged by them. For example, spikes can damage a wood floor, or can be bent by a hard stone surface. There are also hard surfaces for which footwear with projections actually provides less traction than footwear without projections. Using footwear with permanent surface-engaging projections, the wearer generally must face the inconvenience of carrying different types of footwear and changing footwear to cross different surfaces.

Overview

To address the limitations of footwear with permanent surface-engaging projections, certain approaches include projections that can be removed or retracted manually. Several examples of manually-retractable projections require the wearer take some action to activate or deactivate these projections. These actions can include: pulling, pushing, turning, or kicking a lever, knob, or cord; pumping air or fluid; or some combination thereof. Examples of manually-retractable projections include: U.S. Pat. No. 4,375,729 (Wiley T. Buchanen), U.S. Pat. No. 4,821,434 (Chung-Min Chein), U.S. Pat. No. 4,873,774 (Alan W. Lafever), U.S. Pat. No. 5,269,080 (Carl C. Davis), U.S. Pat. No. 5,299,369 (Neil M. Goldman), U.S. Pat. No. 5,337,494 (Thomas H. Ricker), U.S. Pat. No. 5,497,565 (Lionel G. Balgin), U.S. Pat. No. 5,526,589 (J. Charles Jordan), U.S. Pat. No. 5,732,482 (Mark D. Remington), U.S. Pat. No. 5,737,855 (J. Charles Jordan), U.S. Pat. No. 5,836,092 (James R. Yarnell), U.S. Pat. No. 5,870,838 (Rene E. Khayat), U.S. Pat. No. 5,946,828 (J. Charles Jordan), U.S. Pat. No. 5,956,870 (Gerald Grossman), U.S. Pat. No. 6,058,627 (Richard R. Violette), U.S. Pat. No. 6,125,556 (Stephen N. Peckler), U.S. Pat. No. 6,256,907 (J. Charles Jordan), U.S. Pat. No. 6,389,714 (James Mack), U.S. Pat. No. 6,647,647 (Perry Auger), U.S. Pat. No. 7,234,250 (Stacy Renee Fogarty), U.S. Pat. Publication No. 20060021254 (Peter C. Jones), U.S. Pat. Publication No. 20060174518 (Stacy Renee Fogarty), U.S. Pat. Publication No. 20080010859 (Stacy Renee Fogarty), U.S. Pat. Publication No. 20080016721 (Michel Obeydani), U.S. Pat. Publication No. 20080066348 (John Michael O'Brien), and U.S. Pat. Publication No. 20080271341 (Mikael Amark).

Manually-retractable projections offer more flexibility than permanent projections, but still have limitations. There are many times when changes in surface conditions or wearer movement happen too quickly or unexpectedly for the wearer to reach down and manually activate or deactivate surface-engaging projections. For example, someone may unexpectedly step onto a patch of ice, oil, or other slippery substance and start to slide. As another example, an athlete may be playing a game in which low-traction is generally preferred, except for certain moves. In neither case would the wearer have time to reach down and activate surface-engaging projections.

Examples of projections that retract automatically under pressure include U.S. Pat. No. 5,289,647 (Donald R. Mercer) and projections that are surrounded by material that retracts automatically under pressure include U.S. Pat. Publication No. 20070251124 (Thomas Holbert). However, the former can disadvantageously reduce traction when it is most needed, and the latter can disadvantageously cause damage to floors in a manner similar to permanent spikes.

Another approach can involve a directionally yieldable cleat assembly, such as U.S. Pat. No. 5,505,012 (Andrew S. Walker). Such an assembly may create different levels of traction in different directions, but it still is a permanent projection. Therefore, it has the same basic trade-off concerning different surfaces as other permanent projections.

Another approach requires the use of a sensor and computer processor embedded in footwear. Examples include: U.S. Pat. No. 7,310,895 (Saunders Whittlesey), U.S. Pat. Publication Nos. 20050188566 (Saunders Whittlesey), 20070006489 (Charles Whipple Jr.), U.S. Pat. Publication No. 20070261271 (Wayne F. Krouse), U.S. Pat. Publication No. 20080060224 (Saunders Whittlesey). Some of these examples are rather vague in how such a sensor and computer processor can be used. Thus, it can be difficult to pin down the real advantages and limitations of such robotic footwear. However, it is believed unlikely that the combination of a sensor, computer processor, and actuator will act instantly. There will probably be some lag time as information is gathered by the sensor, processed by the processor, and acted upon by the actuator. It is believed that this lag time will probably be greater than the virtually-instantaneous response of a direct mechanical link. Thus, one problem of a computer-based system will probably be lag time. Another problem of a computer-based system is expense. Robotic footwear will probably be expensive, at least for the foreseeable future.

Another approach can involve tilting cleats or wobble plates. For example, U.S. Pat. No. 6,481,122 (George R. Brahler) appears to show a cleat that tilts as the shoe moves. U.S. Pat. No. 7,194,826 (Joseph L. Ungari) appears to show a cleat assembly that pivots as the upper portion of the shoe tilts. These techniques may help retain traction when the shoe tilts, but it is believed that neither involves activation of surface-engaging projections in response to horizontal sliding motion, such as discussed below. U.S. Pat. No. 3,631,614 (Clifford M. Rice) appears to include a wobble plate that is mounted on a vertical axis, and that tilts in response to sliding, and the side of the plate engages the surface. The present inventor believes that use of a wobble plate can have certain limitations. First, the wobble plate does not allow progressive engagement of projections with increasing size; there is only one engagement position when the plate contacts the surface. Second, debris can enter and fill the space above the wobble plate when the plate is tilted. Third, a wobble plate cannot be used to selectively control sliding in one direction more than another. Fourth, a wobble plate can be undesirably tilted, even in the absence of horizontal sliding motion, when a protrusion on an uneven surface pushes the wobble plate upwards.

Another approach to traction is the use of tetrahedral or pentahedral shapes as embodied in chains strapped to the bottom of a shoe. For example, U.S. Pat. Publication No. 20070163146 (Sergei Brovkin) discusses how tetrahedral or pentahedral chains can delay breakaway sliding friction. Such chains strapped to the bottom of a shoe may be useful for some applications, but have limitations. First, they do not activate surface-engaging projections in response to horizontal sliding motion, such as discussed below. Second, chains strapped to a shoe are relatively conspicuous, and therefore, likely undesirable from a style perspective. It is believed that people in many occupations or avocations would be unlikely to wear chains on their shoes throughout the day.

To recap, existing approaches to footwear that accommodates surfaces and motions that require different levels of traction appear to all have certain limitations. Permanent projections damage some floors and offer poor traction on hard surfaces. Manually-activated projections are not useful for unexpected slips or quick moves. Projections that retract under pressure may fail to provide traction when it is most needed. Robotic shoes are likely to be expensive and have response lags. Tilting cleats may help maintain contact with the ground when footwear tilts, but do not activate projections to stop horizontal sliding. Wobble plates do not allow progressive engagement of larger spikes, are vulnerable to debris above the plate, do not allow selective control over traction in different directions, and can be undesirably tilted by uneven surfaces in the absence of horizontal sliding. Shoes with chains can improve traction, but do not activate projections to stop horizontal sliding and are inappropriate for settings where style is a consideration.

The present inventor has recognized, among other things, that it can be desirable to have footwear that can provide one or more surface-engaging projections that can be activated automatically, such as by a change in surface or movement. Accordingly, this document describes, among other things, a novel approach that can include footwear providing traction that can stop horizontal sliding, such as when someone begins to slip (e.g., on ice) or when an athlete rapidly changes direction. In an example, the present approach can provide one or more footwear projections that are brought into contact with a support surface, such as by the horizontal sliding motion of that footwear on that support surface. In an example, this can be accomplished using one or more rolling members, such as on the bottom of the shoe, that can turn around a horizontal axis, or one or more sliding members on the bottom of the shoe that can slide along a horizontal track, or a combination of one or more rolling members and one or more sliding members. Horizontal sliding motion can move such rolling or sliding members, which actuates bringing one or more projections down from the footwear, such as into contact with the surface. This can help stop the horizontal sliding.

This approach can be advantageous over previous or other approaches. Unlike permanent projections, the present approach can, in certain examples, provide one or more projections that can automatically retract in the absence of sliding motion. This can help avoid damaging a floor, in certain examples. Unlike manually-activated projections, the present approach can, in certain examples, provide one or more projections that can be automatically activated, such as during an unexpected slip. Unlike a "robotic" shoe, the present approach can, in certain examples, provide a direct mechanical connection actuated by horizontal motion, such that one or more projections can be automatically extended in response to such horizontal motion with virtually no lag time. The present approach can, in certain examples, be less expensive than a robotic shoe with a sensor and signal processor. Unlike a wobble plate, the present approach, in certain examples: can offer progressive engagement of increasingly-larger projections; can avoid requiring a space above a plate that could be clogged by debris; can selectively adjust traction in different directions; and, can be less vulnerable to being undesirably moved by an uneven surface in the absence of horizontal motion. Unlike chains strapped onto the bottom of a shoe, the present approach can, in certain examples, provide automatic activation of one or more projections in response to horizontal sliding, and can be discretely incorporated within the sole of a shoe, if desired.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIGS. 1 through 3 show one embodiment with a friction belt, two cylindrical rollers, and spikes on the cylindrical rollers.

FIGS. 4 through 5 show another embodiment with a rolling wheel member with spikes of increasing size around its circumference.

FIGS. 6 through 7 show another embodiment with treads that slide along a horizontal track and a spike-like projection created by a rigid folding member connected to these treads.

FIGS. 8 through 9 show another embodiment with a tread that slides along a horizontal track with a descending central spike.

DETAILED DESCRIPTION

Figure 1:
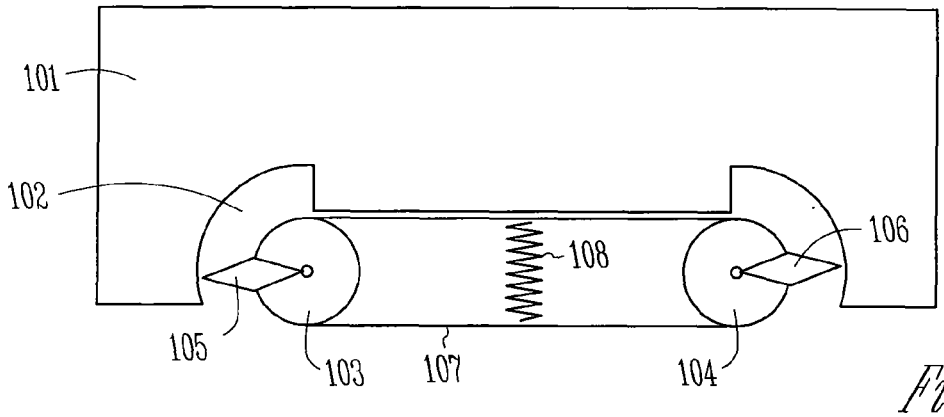
FIGS. 1 through 9 show four possible embodiments of this invention, but do not limit the generalizability of the claims.
Figure 2:
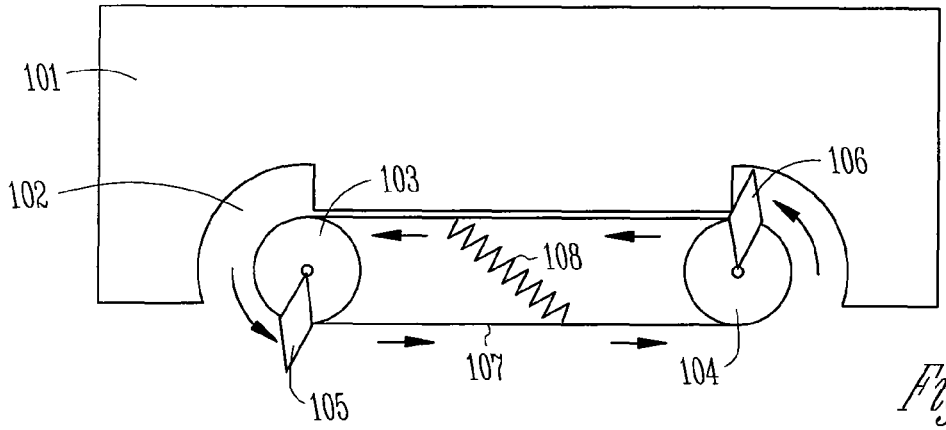
Figure 3:
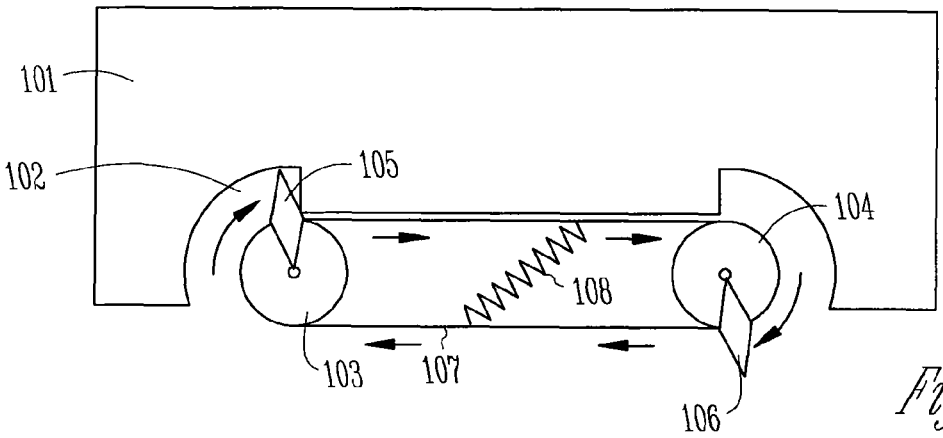

FIGS. 1 through 3 show an example in which a shoe's horizontal sliding motion can cause a friction belt on the bottom of the shoe to move horizontally. This, in turn, can rotate one or more horizontal rollers. This, in turn, can pull a spike or other engagement mechanism down into contact with the floor or other supporting surface. FIG. 1 shows an example of this embodiment before horizontal sliding.

Specifically, the example of FIG. 1 can include a recessed area 102 in a sole 101 of the shoe. The sole can be made of a desired material, such as a synthetic rubber material, in an example. In an example, within the recessed area 102 can be one or more horizontal rollers 103, 104. In an example, one or both of the rollers 103, 104 can include one or more attached radially-projecting spikes 105, 106, or other engagement mechanism, which can be connected, such as by a friction belt 107. In an example, the rollers 103, 104 or the spikes 105, 106 can be made of molded plastic, or a rust-resistant metal. The friction belt 107 can be made from silicone or some other durable, non-slippery material, in an example. A spring 108 can also be connected to the friction belt 107. In an example, in the absence of a horizontal sliding motion, the spring 108 can urge the friction belt 107 to return toward the configuration in which the spikes 105, 106 are both housed within the recessed area 102 in the sole 101 of the shoe.

In an example, there can be multiple structures, such as the one shown in FIG. 1, such as at different locations on the sole 101 of the shoe. For example, there can be multiple structures configured in a radial pattern around the sole 101, such as to inhibit or prevent horizontal sliding equally or similarly in all directions. In an example, multiple structures such as shown in FIG. 1 can be aligned or otherwise arranged, such as to selectively inhibit or prevent horizontal sliding in one or more directions more than in one or more other directions. For example, if desired, forward sliding can be permitted while backward sliding is inhibited.

FIG. 1 shows an example of this embodiment in the absence of horizontal sliding motion, in which both spikes 105, 106 are in a recessed position. FIGS. 2 and 3 show examples of the same embodiment as shown in FIG. 1, but illustrate examples of a right-to-left horizontal slide motion and left-to-right horizontal sliding motion, respectively, of the shoe on the floor.

In the example of FIG. 2, the right-to-left horizontal sliding motion of the shoe on the floor can cause the friction belt 107 to move left-to-right relative to the sole 101. In an example, movement of friction belt 107 rotates the two rollers 103, 104, such as about respective horizontal axes. This, in turn, can cause the spike 105 (or other engagement or frictional mechanism) on the roller 103 to descend into contact with the floor (or ground or other supporting surface), and can cause the spike 106 (or other engagement or frictional mechanism) on the roller 104 to ascend, such as into contact with the top of the recessed area 102. When the spike 106 hits the top of the recessed area 102, it inhibits or halts the rotation of the rollers 103, 104, such as at the point of maximum protrusion of the spike 105. When the spike 105 engages the floor or other support surface, it can help to stop the horizontal sliding motion. FIG. 3 shows an example of a symmetric situation to that shown in FIG. 2, but for left-to-right horizontal sliding motion, instead of right-to-left horizontal sliding motion.

In an example, rotation of the rollers 103, 104 can be abruptly stopped, such as by the contact of the spike 106 with the top of the recessed area 102. In another example, the rotation of the rollers 103, 104 can be more gradually slowed, such as by using a technique involving gradually increasing counter pressure, such as by using a stronger central spring 108, in an example. In an example, this can allow finer control of the process by which the floor (or ground or other supporting surface) is progressively engaged by one or more projections.

Figure 4:
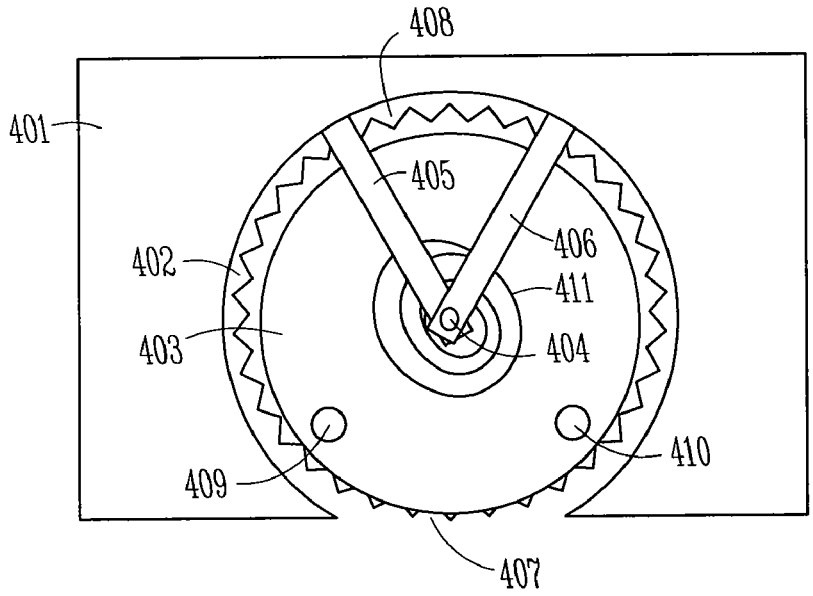
Figure 5:
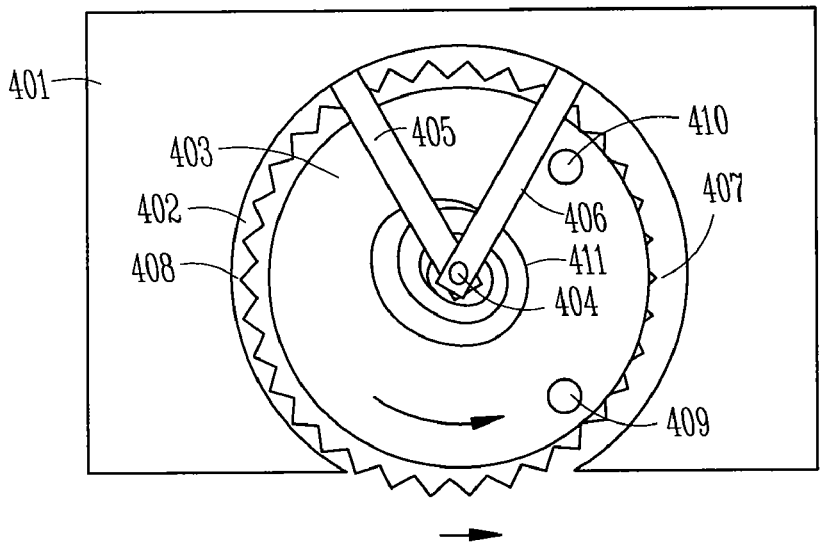

FIGS. 4 and 5 show an example of another embodiment, such as in which a Shoe's horizontal sliding motion can actuate rotating a rolling wheel member, such as with spikes of increasing length around its circumference, or other engagement or frictional mechanisms that can provide increasing traction as the rolling wheel rotates. FIG. 4 shows an example of this embodiment before horizontal sliding motion occurs. FIG. 5 shows an example of this embodiment during such horizontal sliding motion.

The example of FIG. 4 can include a recessed circular area 402, such as in the sole 401 of a shoe. In an example, the sole 401 can be made of synthetic rubber material. Within recessed area 402 can be a rolling wheel member 403, which can rotate around a horizontal axis, such as around a horizontal axial member 404 that can be held in place, such as by one or more struts 405, 406. Around the circumference of the rolling wheel member 403 can be a series of spikes (or other engagement or frictional mechanisms). In an example, the spikes can progress in length around the circumference of the rolling wheel member 403, such as from one or more relatively short spikes in section 407 to one or more relatively long spikes in section 408. In the example of FIG. 4, in the absence of horizontal sliding motion, the section 408 with the largest spikes can be recessed, and section 407 with the shortest spikes can be in contact with the floor. In an example, the rolling wheel member 403, the struts 405, 406, or the spikes can be made of molded polycarbonate plastic or metal.

Various examples can include multiple structures, such as the one shown in FIG. 4, such as at different locations on the sole 401 of the shoe. For example, there can be multiple structures configured in a radial pattern around the sole, such as to inhibit or prevent horizontal sliding similarly or equally in all directions. or to a relative desired degree in a particular direction relative to another desired degree in another direction. In an example, multiple such structures can be aligned or otherwise arranged, such as to selectively inhibit or prevent horizontal sliding in one or more directions more or less than in one or more other directions.

FIG. 5 shows an example of the same embodiment as shown in FIG. 4, but during an example of horizontal sliding motion. In the example of FIG. 5, right-to-left horizontal sliding motion of the shoe is causing a counter-clockwise rotation of the rolling wheel 403. In this example, this rotation of the rolling wheel 403 can cause increasingly large spikes 408 or the like to rotate out of the recessed area 402 and into contact with the floor or other supporting surface. In an example, when the protrusion 409 or 410 hits the strut 405 or 406, it inhibits or halts further rotation of the rolling wheel 403, such as at the point at which the maximum sized spike or spikes can engage the floor or other support surface. As larger spikes 408 engage the floor, they can help to stop the horizontal sliding motion. The spring 411 urges the rolling member 403 to return to the initial position shown in FIG. 4 when the horizontal sliding motion is over.

In another example, there may be variation in the durometer of ground-engaging protrusions around the circumference of the rolling member. For example, softer protrusions can be on the portion of the rolling member that engages the support surface in the absence of horizontal sliding motion. Harder protrusions can be on the portion of the rolling member that rotates down and engages the support surface during horizontal sliding motion. In an example, the softer protrusions can be made of rubber and the harder protrusions can be made of metal.

In this example, the rotation of the rolling wheel 403 can be abruptly stopped, such as by the contact of the protrusion 409 or 410 with the strut 405 or 406. In another example, the rotation of the rolling wheel 403 can be slowed, such as by gradually increasing counter pressure, such as through the use of a stronger spring 411. This can allow finer control of how the surface is progressively engaged by projections of increasing size.

Figure 6:
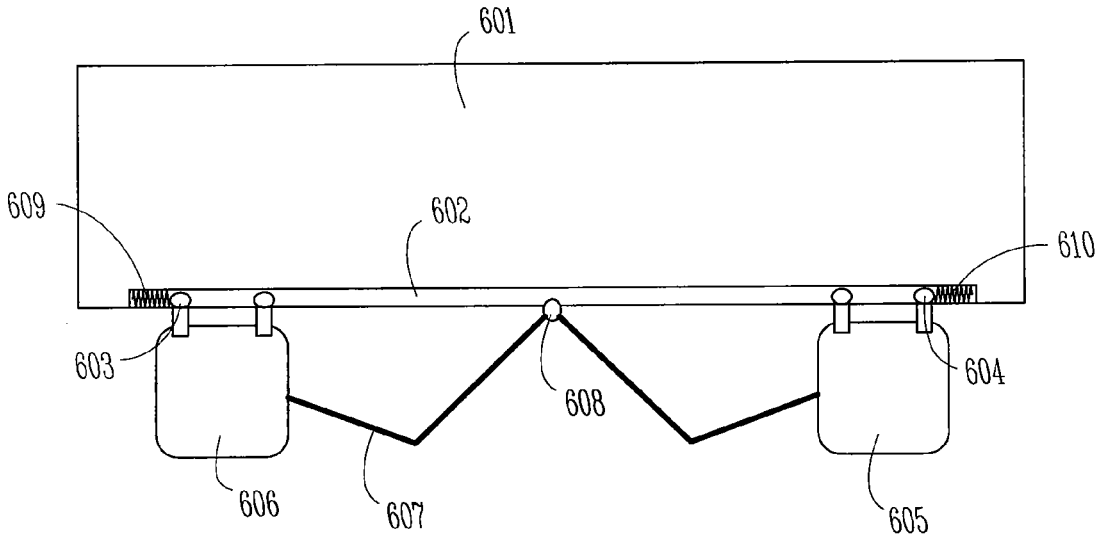
Figure 7:
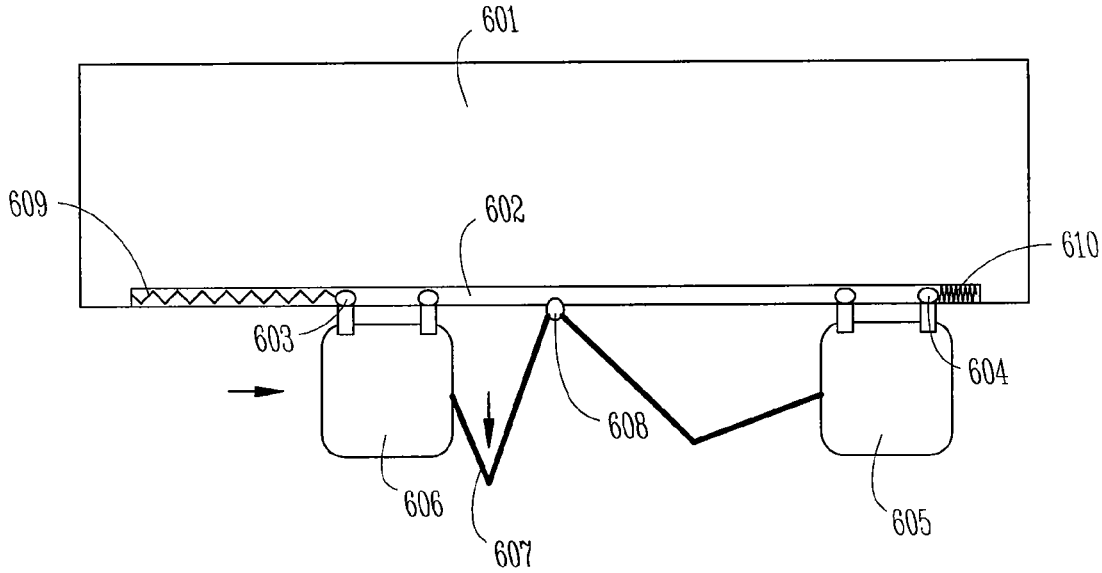

FIGS. 6 and 7 show an example of an embodiment in which horizontal sliding motion can cause a sliding member to slide along a horizontal track. This, in turn, can fold a rigid member into a spike-like projection, which can come into contact with the floor or other supporting structure. FIG. 6 shows an example of this embodiment before horizontal sliding motion occurs. FIG. 7 shows an example of this embodiment during horizontal sliding motion.

In the example of FIG. 6, there can be a horizontal track 602 attached to the bottom of shoe sole 601. One or more circular members 603 and 604 can slide through the horizontal track 602. In an example, the circular members 603 and 604 can be fastened to movable tread members 605 and 606, such that the movable tread members 605 and 606 can slide along the horizontal track 602 in response to horizontal sliding motion of the shoe. The track 602 and the circular members 603 and 604 can be made from a rust-resistant metal. In this example, there can be a folding metal member 607, which can be connected to one or more moving treads 605 and 606. The springs 609 and 610 can urge the movable track members 605 and 606 toward the ends of the track in the absence of horizontal sliding motion. As shown in FIG. 7, the folding metal member 607 can fold outward, such as to form a spike-like projection when the tread member 605 or 606 move inwards along the track 602 in response to horizontal sliding motion.

In various examples, there can be multiple structures such as that shown in FIG. 6, such as at different locations on the sole 601 of the shoe. For example, there can be multiple structures configured in a radial pattern around the sole 601, such as to inhibit or prevent horizontal sliding similarly or equally in all directions. In certain examples, multiple structures can be aligned, such as to selectively inhibit or prevent horizontal sliding in one or more directions more than in one or more other directions.

In the example of FIG. 7, the movable tread member 606 can be pushed inward along the track 602, such as by right-to-left horizontal sliding motion of the shoe on the floor or other surface. This inward motion of the movable tread member 606 can cause the folding metal member 607 to fold downwards, such as into a spike-like projection that can come into contact with the ground or other support surface to help stop the horizontal sliding motion. After the horizontal sliding motion is over, the springs 603 and 604 can restore the moveable tread 607 to the original position shown in FIG. 6, causing the spike-like projection of the folding metal member 607 to retract away from the floor.

Figure 8:
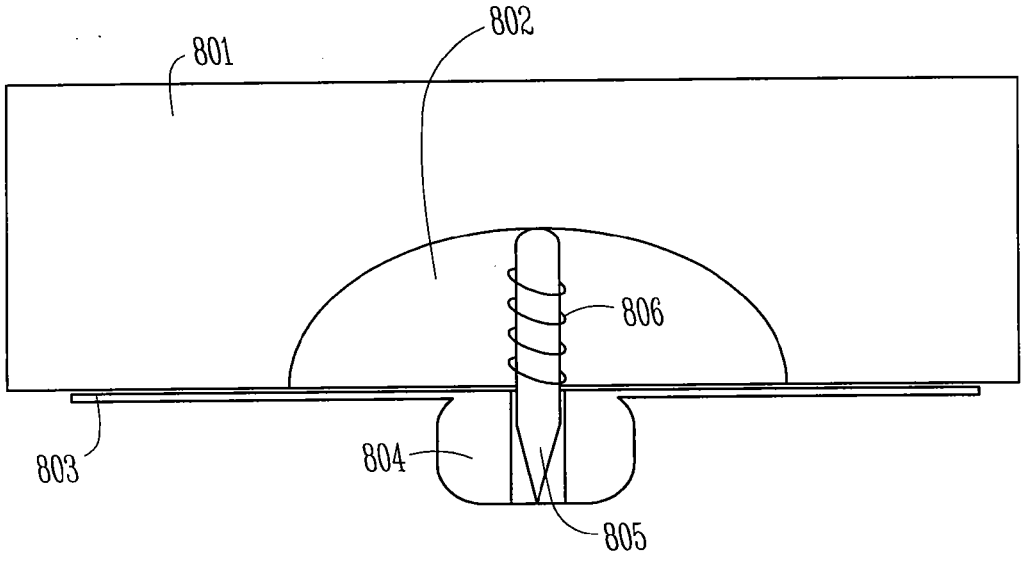
Figure 9:
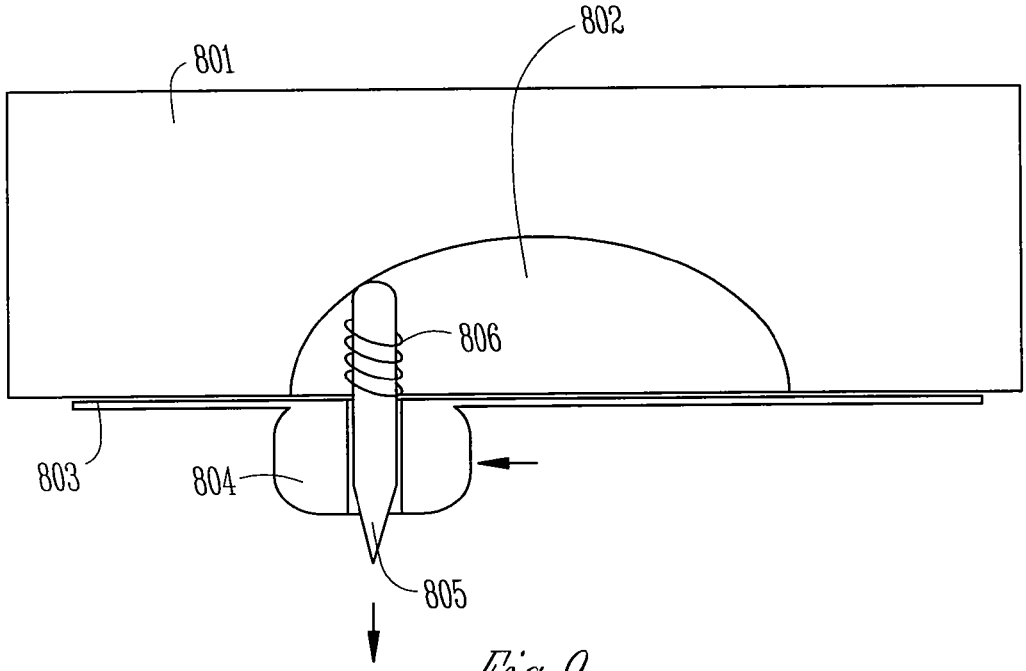

FIGS. 8 and 9 show an example of an embodiment in which horizontal sliding motion can cause a sliding member to slide along a track which, in turn, can cause a spike or the like to be depressed by the concave surface of a compartment in the sole of the shoe. FIG. 8 shows an example of this embodiment before horizontal sliding motion occurs. FIG. 9 shows an example of this embodiment during horizontal slide motion.

In the example of FIG. 8, there can be a concave recessed area 802 in the sole 801 of the shoe. The concave recessed area 802 can be sealed or otherwise isolated from the floor (or ground) such as by a horizontal track 803. In an example, this can help to keep debris out of the moving mechanism. In an example, a moveable tread member 804 can move horizontally along the horizontal track 803, such as in response to a horizontal sliding motion of the shoe on the floor or other surface. A vertical cylindrical hole, such as in the center of the moveable tread member 804, can include a moveable spike 805. In the example of FIG. 8, in the absence of a horizontal sliding motion, the top of the spike 805 protrudes into the concave recessed area 802 above the top of moveable tread member 804. A spring 806, which can be attached to the upper section of spike 805, can urge the spike 805 upwards, in a retracted mode, when the spike 805 and the moveable tread member 804 are in the center of the concave recessed area 802.

In various examples, there can be multiple structures such as that shown in FIG. 8, such as at different locations on the sole 801 of the shoe. For example, there can be multiple structures configured in a radial pattern around the sole, such as to inhibit or prevent horizontal sliding similarly or equally in all directions. In an example, multiple structures can be aligned, such as to selectively inhibit or prevent horizontal sliding in one or more directions more than in one or more other directions.

In the example of FIG. 9, a moveable tread 804 can be pushed along the horizontal track 803, such as to one side of the concave recessed area 802, by horizontal sliding motion of the shoe on the floor or other surface. As the tread 804 moves horizontally, the top of spike 805 can be pushed downward by the roof of the concave recessed area 802. This can cause the spike 802 to descend into contact with the floor or other surface, such as to help slow or stop the horizontal sliding motion. When the horizontal sliding motion is over, the spring 806 can urge the spike 805 upwards, and can thereby urge the moveable tread 804 to return to a central position, such as shown in the example of FIG. 8.

To recap, this document has described, among other things, a novel system of footwear providing traction that can help slow or stop horizontal sliding. The various examples of the present approach—which can be used individually or in combination with each other—can help address certain limitations of certain other approaches. Even with the present approach, however, it is noted that if the rolling or sliding members move too much, then they may detract from stability. Therefore, in certain examples, it can be desirable to let the rolling or sliding members move just enough in response to a horizontal slide so as to activate the surface-engaging projections. This can help slow or stop the slide just when it is starting. It may be desirable to apply an anti-lock-like technique to give up friction for a brief moment in order to inhibit or prevent total loss of friction later.

In addition or alternative to variation in design for the present approach, there can also be variation in scale. The rolling or sliding components or surface-engaging projections can be made on a scale of ranging from nanometers to centimeters, depending on the desired application. For example, shoes designed specifically for stopping sliding motion on ice would likely have larger mechanisms. Shoes designed specifically for traction on gym floors would likely have smaller mechanisms. Intermediate scale designs may work reasonably well across a wide variety of surfaces or applications.

Although the present approach may have certain challenges, on balance, it can provide many advantages over certain other approaches, and can provide considerable potential to slow or stop unwanted horizontal sliding in a variety of settings.

Additional Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown and described. However, the present inventors also contemplate examples in which only those elements shown and described are provided.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. An apparatus for providing an article of footwear with traction with an underlying support surface, the apparatus comprising:

a movable member, located at the bottom of the footwear, the movable member configured to move automatically in response to a sliding motion of the bottom of the footwear, wherein the sliding motion is in a direction that is substantially parallel to the support surface, and wherein the movable member comprises at least one of:

a rolling member, configured to roll across the support surface during the sliding motion; or a sliding member, configured to slide along a track at the bottom of the footwear, during the sliding motion, in a direction that is substantially parallel to the support surface; and an engagement or frictional braking member, mechanically coupled to the movable member, braking member being mechanically driven by the movable member, in response to the sliding motion, such as to increase an engagement or friction provided by the braking member to help slow or stop the sliding motion.

2. The apparatus of claim 1, wherein the braking member comprises a projection that is moved into contact with the support surface, by the movable member, in response to the sliding motion.

3. The apparatus of claim 1, wherein the movable member comprises a rolling member.

4. The apparatus of claim 3, wherein the rolling member presents at least one of a substantially at least semi-cylindrical or at least semi-spherical surface that moves substantially parallel to the support surface during the sliding motion.

5. The apparatus of claim 3, wherein the rolling member includes a generally circular cross-sectional shape in at least one plane that is substantially perpendicular to the support surface, configured to rotate at least partially about an axial element in at least one plane that is substantially parallel to the support surface.

6. The apparatus of claim 3, wherein the rolling member comprises at least one of a wheel, a sphere, or a cylinder.

7. The apparatus of claim 3, comprising a plurality of the rolling members, and wherein at least two of the rolling members are mechanically coupled to each other to provide coordinated rotation of the at least two of the rolling members.

8. The apparatus of claim 7, in which the at least two of the rolling members are mechanically coupled to each other using a friction belt that moves in response to horizontal sliding motion, and wherein movement of the friction belt causes the at least two of the rolling members to roll, and wherein the rolling of the at least two rolling members causes spikes to come into contact with the support surface.

9. The apparatus of claim 3, wherein the rolling member includes progressively longer spikes around a circumference of the rolling member, and wherein the sliding motion causes the rolling member to roll, and wherein rolling of the rolling member in response to the sliding motion causes progressively longer spikes to come into contact with the support surface.

10. The apparatus of claim 1, wherein the movable member comprises a sliding member.

11. The apparatus of claim 10, comprising a track that is substantially parallel to the support surface.

12. The apparatus of claim 10, wherein sliding member comprises a tread that is configured to move in response to the sliding motion, and wherein such movement of the tread is configured to actuate a rigid folding member to fold downward such that a folding metal member comes into contact with the support surface.

13. The apparatus of claim 1, wherein the braking member comprises an engagement member configured to engage at least one of an interior floor surface, an exterior ground surface, or an ice surface.

14. The apparatus of claim 1, wherein the braking member comprises an engagement member comprising at least one of a spike, a nail, a stud, a cleat, a folding angular projection, or a tread.

15. The apparatus of claim 1, wherein the movable member is configured to limit movement of the movable member in response to the sliding motion such that the movable member is positioned to drive the braking member to provide substantially a maximum engagement or friction with the support surface relative to other positions within a range of the movement of the movable member.

16. An apparatus for providing an article of footwear with traction with an underlying support surface, the apparatus comprising:

a movable member, located at the bottom of the footwear, the movable member configured to move automatically in response to a sliding motion of the bottom of the footwear, wherein the sliding motion is in a direction that is substantially parallel to the support surface, and wherein the movable member comprises:

a sliding member, configured to slide along a track at the bottom of the footwear, during the sliding motion, in a direction that is substantially parallel to the support surface, wherein sliding member comprises a tread that is configured to move in response to the sliding motion, and wherein such movement of the tread is configured to actuate a rigid folding member to fold downward such that a folding metal member comes into contact with the support surface; and an engagement or frictional braking member, mechanically coupled to the movable member, braking member being mechanically driven by the movable member, in response to the sliding motion, such as to increase an engagement or friction provided by the braking member to help slow or stop the sliding motion.

* * * * *